US010046930B2

(12) United States Patent
Eiji et al.

(10) Patent No.: US 10,046,930 B2
(45) Date of Patent: Aug. 14, 2018

(54) PRINT MEDIUM SUPPLY APPARATUS AND IMAGE FORMING APPARATUS HAVING THE SAME

(71) Applicant: S-PRINTING SOLUTION CO., LTD., Suwon-si, Gyeonggi-do (KR)

(72) Inventors: Aoki Eiji, Suwon-si (KR); Jin Soo Lee, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 8 days.

(21) Appl. No.: 15/402,803

(22) Filed: Jan. 10, 2017

(65) Prior Publication Data

US 2017/0203931 A1 Jul. 20, 2017

(30) Foreign Application Priority Data

Jan. 19, 2016 (KR) ..... 10-2016-0006601

(51) Int. Cl.

| | |
|---|---|
| ***B65H 3/34*** | (2006.01) |
| ***B65H 3/06*** | (2006.01) |
| ***G03G 15/00*** | (2006.01) |
| *B65H 3/52* | (2006.01) |
| *B65H 3/54* | (2006.01) |

(52) U.S. Cl.

CPC ..... *B65H 3/0638* (2013.01); *B65H 3/0669* (2013.01); *B65H 3/0684* (2013.01); *B65H 3/34* (2013.01); *G03G 15/6529* (2013.01); *G03G 15/6552* (2013.01); *B65H 3/52* (2013.01); *B65H 3/54* (2013.01); *B65H 2403/42* (2013.01); *B65H 2404/1115* (2013.01); *B65H 2404/1116* (2013.01); *B65H 2404/133* (2013.01); *B65H 2801/06* (2013.01)

(58) Field of Classification Search

CPC ..... B65H 3/0638; B65H 3/34; B65H 2404/1118; B65H 3/22; B65H 3/52; B65H 3/54

See application file for complete search history.

(56) References Cited

U.S. PATENT DOCUMENTS 5,462,373 A * 10/1995 Chia ..... B65H 3/0638 271/114
2007/0007709 A1 1/2007 Miyazaki et al.
2010/0320675 A1* 12/2010 Kim ..... B02C 18/0007 271/109

FOREIGN PATENT DOCUMENTS

JP 63112332 A * 5/1988
JP 2004-238132 8/2004
JP 2005-194093 7/2005
JP 2011-57386 3/2011

(Continued)

OTHER PUBLICATIONS

International Search Report dated Apr. 25, 2017 from International Patent Application No. PCT/KR2017/000565, 3 pages.

*Primary Examiner* — Howard J Sanders
(74) *Attorney, Agent, or Firm* — Staas & Halsey LLP

(57) ABSTRACT

An image forming apparatus includes a print medium tray in which a print medium is loaded and a pickup roller which is configured to pick up the loaded print medium from the print medium tray. The pickup roller includes at least one first pickup block and at least one second pickup block configured to alternately come into contact with an upper portion of the loaded print medium. Using such a configuration, the pickup performance of the image forming apparatus may be improved.

20 Claims, 19 Drawing Sheets

(56) References Cited

FOREIGN PATENT DOCUMENTS

| | | |
|---|---|---|
| JP | 2014-40287 | 3/2014 |
| JP | 2015-67396 | 4/2015 |

* cited by examiner

PRINT MEDIUM SUPPLY APPARATUS AND IMAGE FORMING APPARATUS HAVING THE SAME

CROSS-REFERENCE TO RELATED APPLICATION

This application claims the priority benefit of Korean Patent Application No. 10-2016-0006601, filed on Jan. 19, 2016, in the Korean Intellectual Property Office, the disclosure of which is incorporated herein by reference in its entirety.

BACKGROUND

1. Field

Embodiments of the disclosure relate to a print medium supply apparatus and an image forming apparatus having the same, and more particularly, to a print medium supply apparatus improved to improve pickup performance thereof and an image forming apparatus having the same.

2. Description of the Related Art

Image forming apparatuses are apparatuses configured to form images on a print medium in response to input signals and may include printers, copier, facsimiles, multi-function printers implemented by integrating functions thereof, and the like.

Such an image forming apparatus is provided with a print medium supply apparatus for supplying a print medium. Conventionally, a print medium supply apparatus picks up a loaded print medium one sheet at a time and supplies the print medium to an image forming apparatus.

Specifically, one or more print media are loaded in the print medium supply apparatus, are picked up one sheet at a time by a pickup roller, pass through a supply roller, and are supplied to a main body of the image forming apparatus.

However, in the process of supplying a print medium, when friction between the loaded print media is large, surfaces of the print media are not uniform, cutting states of perimeters of the print media are not acceptable, or the like, pickup is not performed smoothly, and thus a problem in which the plurality of print media are introduced occurs, or the print medium is not introduced occurs. Accordingly, a problem in that the image forming apparatus malfunctions or the like occurs.

SUMMARY

Therefore, it is an aspect of the disclosure to provide a print medium supply apparatus improved to improve pickup performance of a pickup roller, and an image forming apparatus having the same.

It is another aspect of the disclosure to provide a print medium supply apparatus in which an overall size of an image forming apparatus is decreased or utilization of an inside space thereof is improved by miniaturizing the print medium supply apparatus, and the image forming apparatus having the same.

Additional aspects of the disclosure will be set forth in part in the description which follows and, in part, will be apparent from the description, or may be learned by practice of the disclosure.

In accordance with an aspect of the disclosure, an image forming apparatus may include a print medium tray in which a print medium is loaded, and a pickup roller configured to pick up the loaded print medium from the print medium tray. The pickup roller may include at least one first pickup block and at least one second pickup block configured to alternately come into contact with an upper portion of the loaded print medium.

The first and second pickup blocks are respectively and biasedly disposed at one and the other sides with respect to a center of a width of a print medium to biasedly pick up the print medium with respect to a supply direction of the print medium.

The alternate contacts of the at least one first pickup block and the at least one second pickup block are achieved by rotation of the pickup roller.

The at least one first pickup block and the at least one second pickup block are respectively disposed at one and the other sides of the pickup roller along a perimeter of the pickup roller, wherein the at least one first pickup block and the at least one second pickup block are mutually alternately disposed in a circumferential direction of the pickup roller.

The pickup roller further may include a roller body at which the at least one first pickup block and the at least one second pickup block are respectively positioned at one and the other ends thereof and which forms a body of the pickup roller, and the at least one first pickup block and the at least one second pickup block respectively include a plurality of first pickup blocks and a plurality of second pickup blocks, which are spaced apart from each other in a circumferential direction of the pickup roller.

The plurality of first pickup blocks and the plurality of second pickup blocks may be mutually alternately disposed.

The image forming apparatus further may include a pressing bar configured to come into contact with the upper portion of the loaded print medium at an upstream position with respect to the pickup roller in a proceeding direction of the print medium.

The pressing bar may include a bar body configured to operate independently of rotation of the pickup roller and rotatably disposed around the roller body, and a bar contact portion configured to extend from the bar body and provided to come into contact with the upper portion of the loaded print medium.

The bar contact portion is provided to come into contact with the upper portion of the loaded print medium, wherein the bar contact portion is provided to come into contact with the upstream position with respect to the pickup roller in a supply direction of a print medium.

The at least one first pickup block may include a first independent contact section configured to come into contact with a print medium, and a first common contact section configured to be adjacent to the first independent contact section and configured to come into contact with the print medium at the same time as the at least one second pickup block. The at least one second pickup block may include: a second independent contact section configured to come into contact with a print medium, and a second common contact section configured to be adjacent to the second independent contact section and configured to come into contact with the print medium at the same time as the at least one first pickup block.

The pickup roller may include a space section in which, when a pickup operation is performed by the pickup roller, neither the at least one first pickup block nor the at least one second pickup block comes into contact with a print medium and which is formed in a circumferential direction of the pickup roller.

In accordance with an aspect of the disclosure, an image forming apparatus may include a main body, and a print medium supply apparatus including a pickup roller configured to pick up a print medium, which is loaded, and configured to supply the print medium to the main body. The pickup roller may include a roller body rotatably provided, and a first pickup part and a second pickup part respectively including at least one first pickup block and at least one second pickup block, which protrude in a radial direction and disposed at one and the other sides of the roller body, and the at least one first pickup block and the at least one second pickup block are mutually alternately disposed in a circumferential direction of the pickup roller.

The pickup roller may be disposed on a center line of a width of the print medium.

The at least one first pickup block and the at least one second pickup block may be configured to alternately come into contact with an upper portion of the loaded print medium by rotation of the pickup roller.

The at least one first pickup block and the at least one second pickup block respectively may include a plurality of first pickup blocks and a plurality of second pickup blocks, which are spaced apart from each other in the circumferential direction of the pickup roller.

The image forming apparatus further may include a pressing bar provided to come into contact with an upper portion of the loaded print medium at an upstream position with respect to the pickup roller in a proceeding direction of the print medium. The pressing bar may include a bar body configured to operate independently of rotation of the pickup roller and rotatably disposed around the roller body, and a bar contact portion formed to extend from the bar body and provided to come into contact with the upper portion of the loaded print medium.

The bar contact portion may be provided to come into contact with the upper portion of the loaded print medium at the upstream position with respect to the pickup roller in a supply direction of the print medium.

In accordance with an aspect of the disclosure, a method of supplying a print medium in an image forming apparatus including a print medium tray in which a print medium is loaded, may include: alternately coming into contact with an upper portion of a print medium loaded in the print medium tray by a plurality of first and second pickup blocks formed on a pickup block and picking up the print medium.

The plurality of first and second pickup blocks may be biasedly disposed at one and the other sides with respect to a center of a width of the print medium to biasedly pick up the print medium with respect to a supply direction of the print medium.

BRIEF DESCRIPTION OF THE DRAWINGS

These and/or other aspects and advantages will become apparent and more readily appreciated from the following description of the embodiments, taken in conjunction with the accompanying drawings in of which.

DETAILED DESCRIPTION

Figure 1:
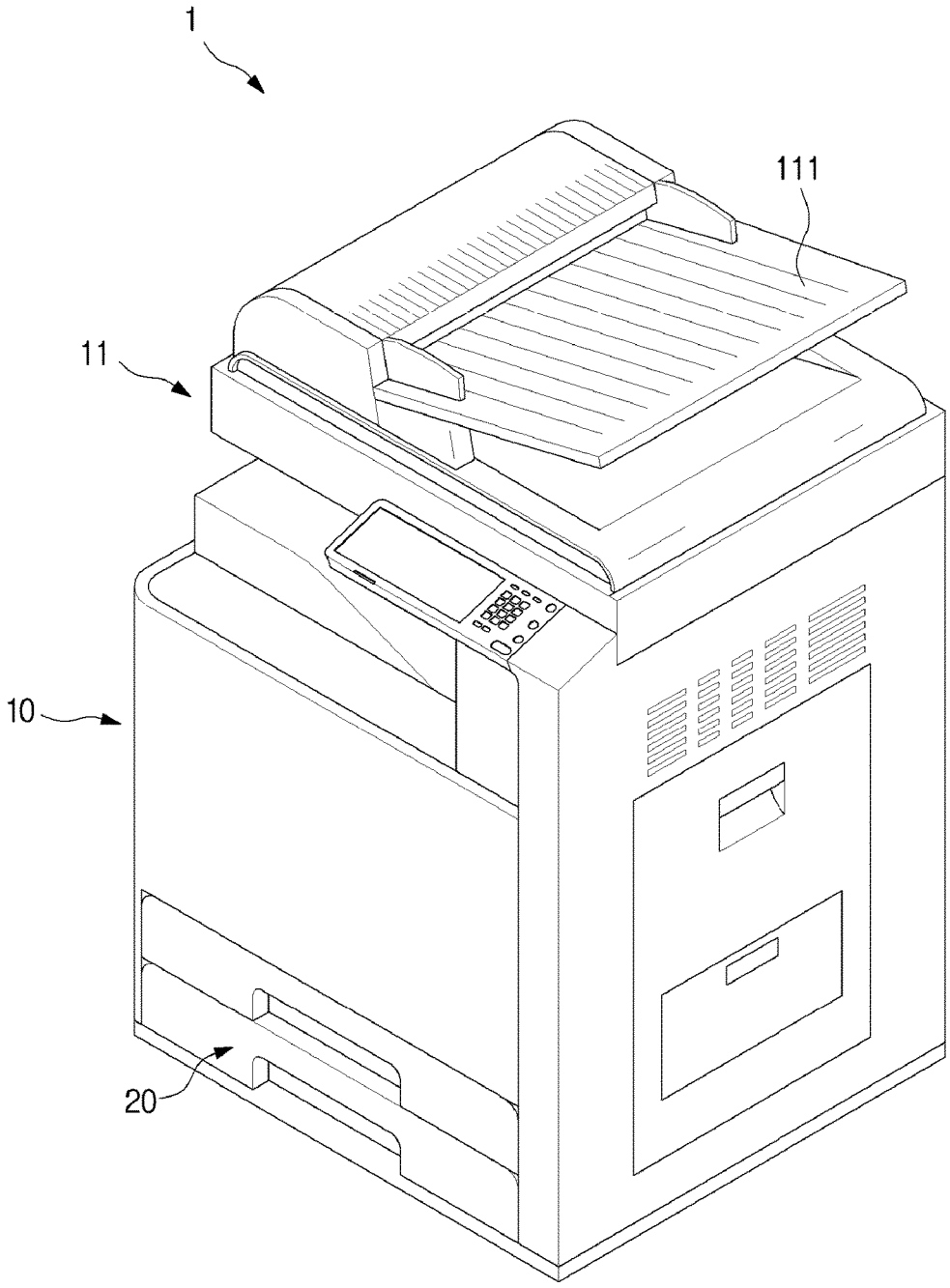
FIG. 1 is a perspective view illustrating an image forming apparatus according to an embodiment of the disclosure.

Reference will now be made in detail to embodiments, examples of which are illustrated in the accompanying drawings, wherein like reference numerals refer to like elements throughout. In this regard, the embodiments may have different forms and should not be construed as being limited to the descriptions set forth herein. Accordingly, the embodiments are merely described below, by referring to the figures, to explain aspects.

Embodiments described in this specification and configurations illustrated in drawings are only exemplary examples of the disclosed disclosure. The disclosure covers various modifications that can substitute for the embodiments and drawings herein at the time of filing of this application In addition, the same reference numerals or symbols refer to parts or components that substantially perform the same function.

In addition, the terms used in the specification are merely used to describe exemplary embodiments, and are not intended to limit and/or restrict the embodiments. An expression used in the singular encompasses the expression of the plural unless it has a clearly different meaning in context. In the specification, the terms such as "including," "having," and "comprising" are intended to indicate the presence of the features, numbers, steps, actions, components, parts, or combinations thereof disclosed in the specification, and are not intended to preclude the possibility that one or more other features, numbers, steps, actions, components, parts, or combinations thereof may be present or added.

In addition, it should be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the disclosure. As used herein, the term "and/or" includes any and all combinations of one or more of the associated listed items.

Hereinafter, embodiments of the disclosure will be described with reference to the accompanying drawings in detail.

Figure 2:
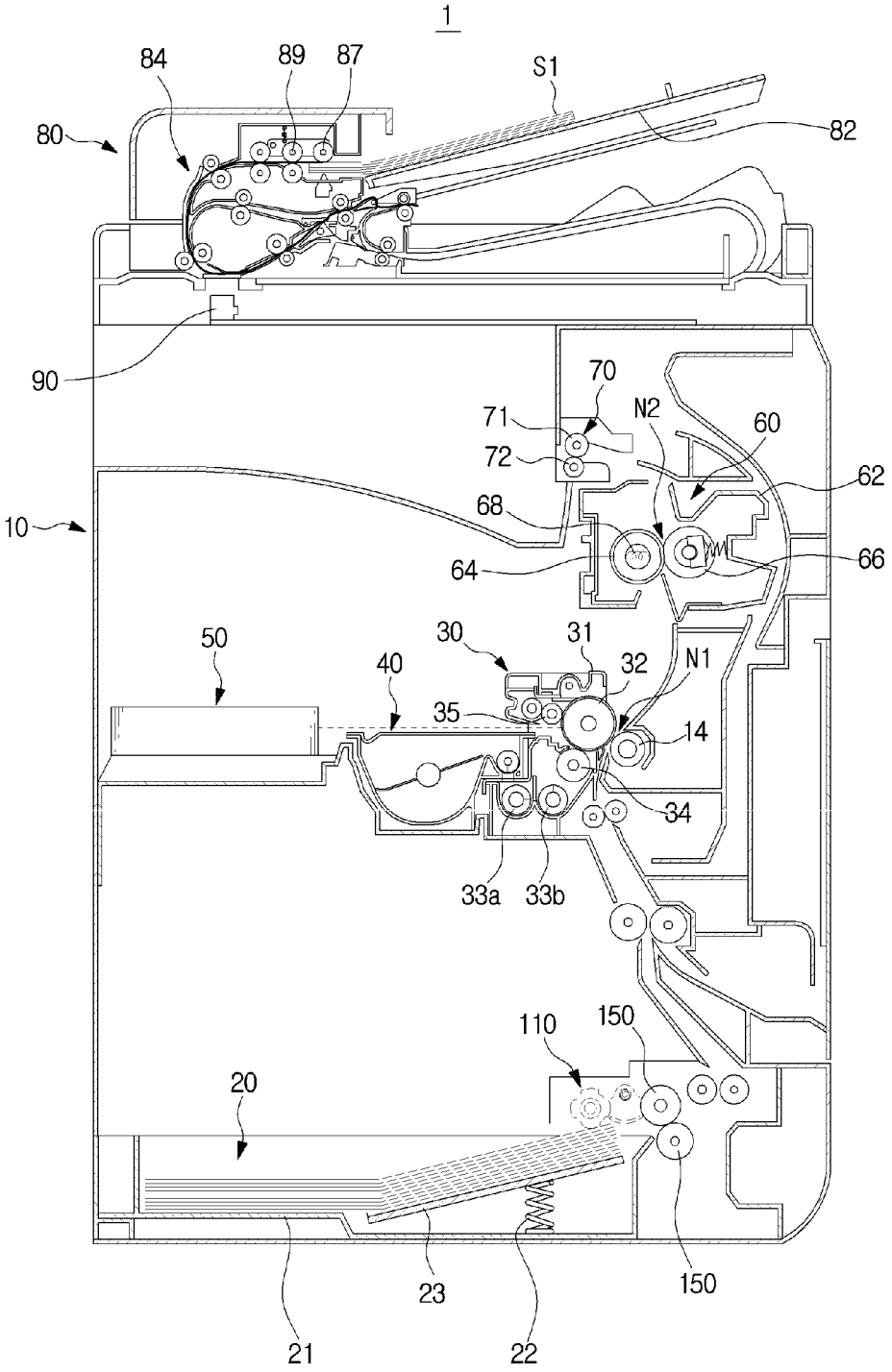
FIG. 2 is a cross-sectional view illustrating an image forming apparatus according to an embodiment of the disclosure.

As illustrated in FIGS. 1 and 2, an image forming apparatus 1 may include a main body 10, print medium supply apparatuses 20 configured to store and supply a print medium S, a developer 30 configured to form an image on the print medium S supplied through the print medium supply apparatus 20, a toner apparatus 40 configured to supply toner to the developer 30, an optical scanner 50 configured to form an electrostatic latent image on a photoreceptor 32 of the developer 30, a fuser 60 configured to fuse a toner image transferred to the print medium S on the print medium S, and a discharger 70 configured to discharge the print medium S on which the image is completely formed to the outside of the main body 10.

The print medium supply apparatus 20 is for storing and supplying a print medium S. The print medium supply apparatus 20 may be provided in a lower portion of the main body 10 to supply the print medium S toward the developer 30.

The print medium supply apparatus 20 may include a print medium tray 21 configured to store the print medium S and coupled to the main body 10 to be openable and closable and a pickup unit 100 configured to pick up the print medium S stored in the print medium tray 21 one sheet at a time to transfer the print medium S toward the developer 30.

In the print medium tray 21, a knock-up plate 23, of which one end is rotatably coupled thereto to guide the loaded print medium S toward a transferring member 25 and the other end is supported by a pressing spring 22, may be provided.

The pickup unit 100 may include a pickup roller 110 configured to pick up the print medium S, loaded in the knock-up plate 23, one sheet at a time and a feed roller 150 configured to transfer the picked-up print medium S by the pickup roller 110 toward the developer 30.

The developer 30 may include a housing 31 which forms an exterior, the photoreceptor 32 rotatably coupled to an inside of the housing 31 and configured to form an electrostatic latent image, agitating screws 33*a* and 33*b* configured to agitate toner supplied from the toner apparatus 40, a developing roller 34 configured to supply the toner agitated by the agitating screws 33*a* and 33*b* to the photoreceptor 32, and a charging member 35 configured to charge the photoreceptor 32.

The toner supplied from the toner apparatus 40 is introduced into the housing 31, is agitated by the agitating screws 33*a* and 33*b*, and is transferred to one side in the housing 31, and the agitated and transferred toner is supplied to the photoreceptor 32 by the developing roller 34 to form a visible image.

The photoreceptor 32 comes into contact with a transfer roller 14 to transfer the toner, which was supplied to the photoreceptor 32 and which formed the visible image on the print medium S, and forms a transfer nip N1. The transfer roller 14 is rotatably disposed in the main body 10.

The toner apparatus 40 is coupled to the developer 30. The toner apparatus 40 accommodates and stores toner for forming an image on the print medium S and supplies the toner to the developer 30 when an image forming operation is performed.

The optical scanner 50 emits light including image information to the photoreceptor 32 and forms an electrostatic latent image on the photoreceptor 32.

The fuser 60 may include a housing 62, and a heating member 64 and a pressing member 66 which are rotatably disposed in the housing 62.

The print medium S on which a toner image is transferred passes between the heating member 64 and the pressing member 66, and here, the toner image is fixed to the print medium S by heat and pressure.

The heating member 64 rotates while being engaged with the pressing member 66, forms a fusing nip N2 with the pressing member 66, is heated by a heat source 68, and transfers heat to the print medium S which passes through the fusing nip N2. The heating member 64 may include a heating roller which receives power from a driving source (not shown) to rotate. The heat source 68 for applying heat to the print medium S on which toner is transferred is disposed in the heating member 64. Although a halogen lamp may be used as the heat source 68, the heat source 68 may be variously implemented with an electrical heating wire, an induction heater, or the like besides a halogen lamp.

The pressing member 66 may be disposed to be in contact with an outer circumferential surface of the heating member 64 and forms the fusing nip N2 between the heating member 64 and the pressing member 66. The heating member 64 may include a pressing roller which receives power from the driving source (not shown) and rotates.

The discharger 70 may include a first discharging roller 71 and a second discharging roller 72, which engage with each other, and discharges the print medium S which passed through the fuser 60 to the outside of the main body 10.

An image reader 80 configured to scan a document S1 may be positioned on the main body 10. The image reader 80 may include a print medium supply tray 82 in which the document S1 to be scanned is loaded, a pickup roller 87 configured to pick up a print medium S1 loaded in the print medium supply tray 82 and to deliver the print medium to a print medium conveying path 84, and a feed roller 89 configured to deliver the print medium S1. A document delivered by the feed roller 89 may be scanned by a scanner module 90 and may be guided toward a discharging unit (not shown) positioned below the print medium supply tray 82.

The print medium S is loaded in the print medium tray 21 provided in the main body 10, is picked up and transmitted one sheet at a time by a pickup roller 87. In addition, the print medium S1 loaded in the print medium supply tray 82 provided at a side of the image reader 80 may also be picked up and transmitted one sheet at a time by the pickup roller 87. The print medium S loaded in the print medium tray 21 and the print medium S1 loaded in the print medium supply tray 82 are respectively picked up and supplied one sheet at a time by the pickup rollers 110 and 87, and when the loaded print media S and S1 are formed of a material with large friction, or surfaces of the print media are not uniform, or cutting states of perimeters of the print media are not acceptable, or the like, a problem in that a plurality of print media are introduced, or a print medium is not introduced occurs.

Accordingly, a structure which allows print media S and S1 to be uniformly picked up may be provided at a side of the print medium supply apparatus 20 or the image reader 80.

Hereinafter, a structure of the print medium supply apparatus 20 or the image reader 80 of which pickup performance of print media S and S1 is improved will be described. For the sake of convenience in the description, the pickup roller 110 applied to the print medium supply apparatus 20 will be described. However, the pickup roller 110 is not limited thereto and may be applied to the pickup roller 87 applied to the image reader 80.

Figure 3:
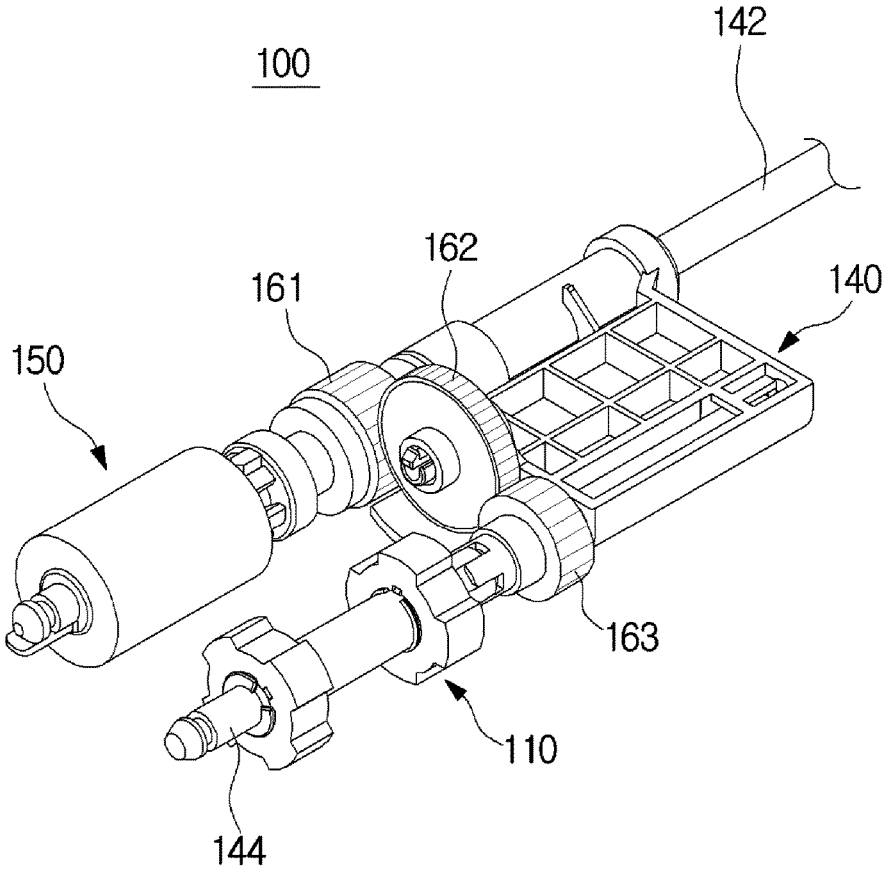
FIG. 3 is a perspective view illustrating one structure of a print medium supply apparatus according to an embodiment of the disclosure.
Figure 4:
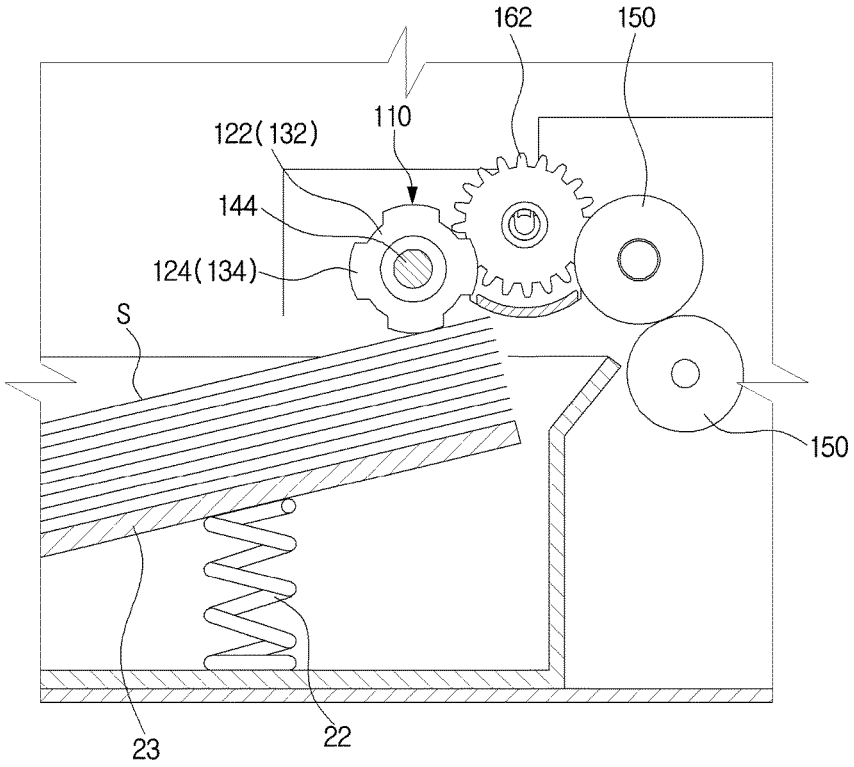
FIG. 4 is a cross-sectional view illustrating one structure of the print medium supply apparatus according to an embodiment of the disclosure.
Figure 5:
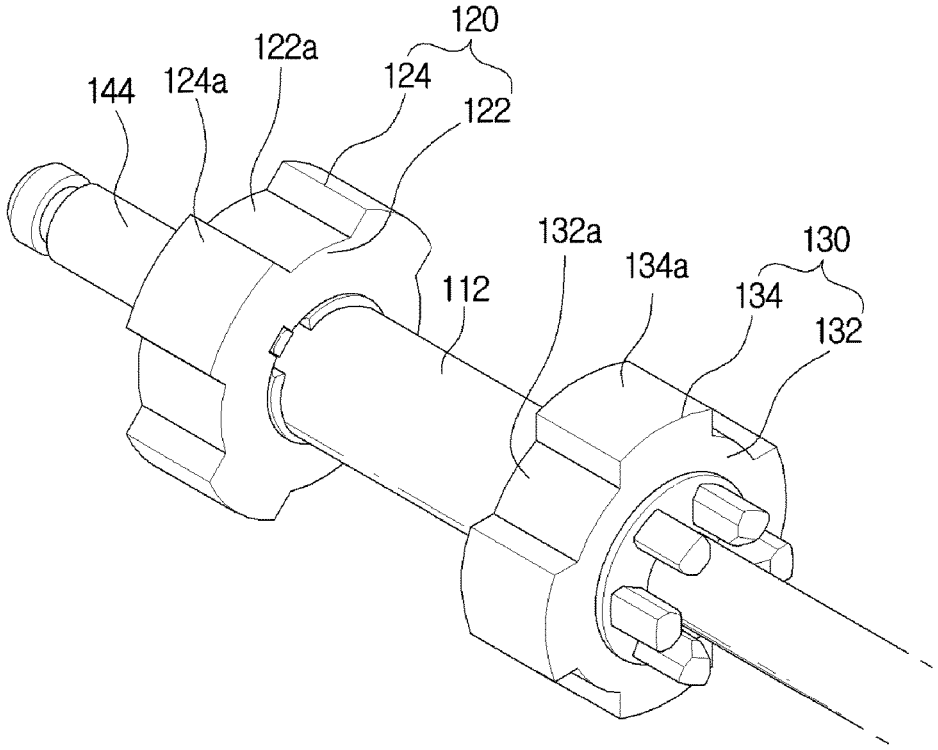
FIG. 5 is a perspective view illustrating a pickup roller 110 according to an embodiment of the disclosure.

FIG. 3 is a perspective view illustrating one structure of a print medium supply apparatus according to one embodiment of the disclosure, FIG. 4 is a cross-sectional view illustrating one structure of the print medium supply apparatus according to one embodiment of the disclosure, and FIG. 5 is a perspective view illustrating a pickup roller 110 according to one embodiment of the disclosure.

The pickup unit 100 may include the pickup roller 110, a pickup holder 140, and the feed roller 150.

The feed roller 150 is disposed behind the pickup roller 110 and provided to transfer a print medium picked up by the pickup roller 110 into the image forming apparatus. The feed roller 150 may be coupled to a first shaft 142 which is coupled to a driving source (not shown) to rotate. The feed roller 150 and the pickup roller 110 may be disposed to be spaced apart from each other so that rotations thereof do not interfere with each other.

The pickup roller 110 and the feed roller 150 may be connected through the pickup holder 140. The pickup holder 140 rotatably supports the pickup roller 110 and is provided to rotate about the first shaft 142 for raising or lowering the pickup roller 110.

Each of the feed roller 150 and the pickup roller 110 may be supported by the pickup holder 140. The pickup holder 140 is provided to rotate about the first shaft 142 and to raise or lower the pickup roller 110 on the basis of an amount of print medium in the print medium tray.

The first shaft 142 which rotates with the feed roller 150 may be disposed at one side of the pickup holder 140, and a second shaft 144 which rotates with the pickup roller 110 may be disposed at the other side.

The pickup unit 100 may include a plurality of gears configured to transfer a rotational force transferred to the first shaft 142 to the second shaft 144 on which the pickup roller 110 is disposed. Through such a structure, when the first shaft 142 is rotated by the driving source, the second shaft 144 is rotated by a plurality of gears 161, 162, and 163, and the pickup roller 110 also rotates. However, transferring a driving force to the pickup roller 110 is not limited thereto, a driving force, for example, may be directly transferred to the second shaft 144 rather than to the plurality of gear 161, 162, and 163 and thus the pickup roller 110 may also operate.

The pickup roller 110 may be disposed on the loaded print medium S of the print medium tray. Specifically, the pickup roller 110 may be disposed on an upper end of an edge of the print medium tray in a supply direction of the print medium S. The print medium S loaded in the print medium tray is picked up one sheet at a time from an uppermost print medium by rotation of the pickup roller 110.

The pickup roller 110 may be coupled to the second shaft 144 to rotate with the second shaft 144. The pickup roller 110 may be disposed on a center line C of a width of the print medium S.

The pickup roller 110 may include a roller body 112.

The roller body 112 is coupled to the second shaft 144 and is provided to rotate with the second shaft 144. The roller body 112 may be formed in an approximately cylindrical shape.

The pickup roller 110 may include first and second pickup parts 120 and 130.

The first and second pickup parts 120 and 130 are provided to come into contact with the print medium S, and the first and second pickup parts 120 and 130 are also provided to rotate with the pickup roller 110. The first and second pickup parts 120 and 130 are provided to pick up the print medium S from the print medium tray so that the picked-up print medium S is biased with respect to a supply direction M in which the print medium S is supplied.

Since the first and second pickup parts 120 and 130 alternately pick up the print medium as described below, the print medium may move in a supply direction and simultaneously may slip in a direction perpendicular to the supply direction. When a frictional force between the loaded print media or surfaces thereof are not uniform, cutting states of perimeters of print media are not acceptable, or the like, a problem in which a plurality of print media are introduced, or the print medium is not introduced occurs. Accordingly, since the first and second pickup parts 120 and 130 pick up the print medium while one uppermost print medium among the loaded print media moves in a supply direction and slips in a left or right direction, a frictional force between the print media can be decreased.

The first and second pickup parts 120 and 130 may be respectively and biasedly disposed toward one and the other sides with respect to a center of a width of a print medium. Specifically, the roller body 112 may be disposed on a center of a width of a print medium, and the first and second pickup parts 120 and 130 may be respectively disposed at one and the other sides of the roller body 112. That is, the first and second pickup parts 120 and 130 may be disposed at one and the other sides of the roller body 112 to face each other.

The first and second pickup parts 120 and 130 may include first and second pickup bodies 122 and 132, respectively. The first and second pickup bodies 122 and 132 are provided to form bodies of the first and second pickup parts 120 and 130 and to cover a perimeter of the roller body 112.

The first and second pickup parts 120 and 130 may respectively include at least one first pickup block 124 and at least one second pickup block 134. When the print medium S is picked up, at least one first pickup block 124 and at least one second pickup block 134 are provided to come into direct contact with the print medium S at the time of picking up the print medium and are configured to pick up one sheet from an uppermost print medium among the loaded print media S at a time At least one first pickup block 124 and at least one second pickup block 134 may be provided to be disposed along a perimeter of the pickup roller 110. Specifically, at least one first pickup block 124 and at least one second pickup block 134 are respectively provided to be disposed along perimeters of the first and second pickup body 122 and 132. The pickup blocks may be formed to protrude from the pickup bodies, and the pickup part may be provided to be formed in an approximately sawtoothed shape. At least one first pickup block 124 and at least one second pickup block 134 may respectively include first and second contact surfaces 124*a* and 134*a* formed in curved shapes to come into contact with a print medium at outermost perimeters thereof. In addition, the pickup roller 110 may include first and second non-contact surfaces 122*a* and 132*a* on which pickup blocks are not formed on the pickup body and that form a step with the first and second contact surfaces 124*a* and 134*a* so as not to come into contact with the print medium.

One first pickup block 124 and one second pickup block 134 may be provided, or a plurality of first and second pickup blocks 124 and 134 may also be formed. In the embodiment of the disclosure, the plurality of first and second pickup blocks 124 and 134 are formed to be described for the sake of convenience in the description.

The plurality of first and second pickup blocks 124 and 134 may be disposed to be spaced apart from each other along perimeters of the first and second pickup bodies 122 and 132. In the embodiment, the pickup blocks are disposed to be spaced predetermined distances from each other, but are not limited thereto, and spacing distances may also vary based on a type, weight, a state of the print medium, or the like. The plurality of first and second pickup blocks 124 and 134 may include the first and second contact surfaces 124*a* and 134*a* formed in curved surfaces to come into contact with a print medium at outermost perimeters thereof.

The pluralities of first and second pickup blocks 124 and 134 may be mutually alternately disposed in a circumferential direction of the pickup roller 110. In other words, the plurality of first pickup blocks 124 formed on the first pickup body 122 may be mutually alternately disposed with the plurality of second pickup blocks 134 formed on the second pickup body 132.

Through such a structure, the plurality of first and second pickup blocks 124 and 134 may alternately come into contact with an upper portion of the loaded print medium S by rotation of the pickup roller 110. That is, in a process of picking up the print medium S, at least one pickup block of the first pickup block 124 and the second pickup block 134 may come into contact with the print medium S.

Hereinafter, an operation of the pickup roller 110 according to the embodiment of the disclosure will be described.

When the image forming apparatus operates, a loaded print media are supplied one sheet at a time from an uppermost print medium in a supply direction of the print medium by the pickup roller 110.

Figure 6:
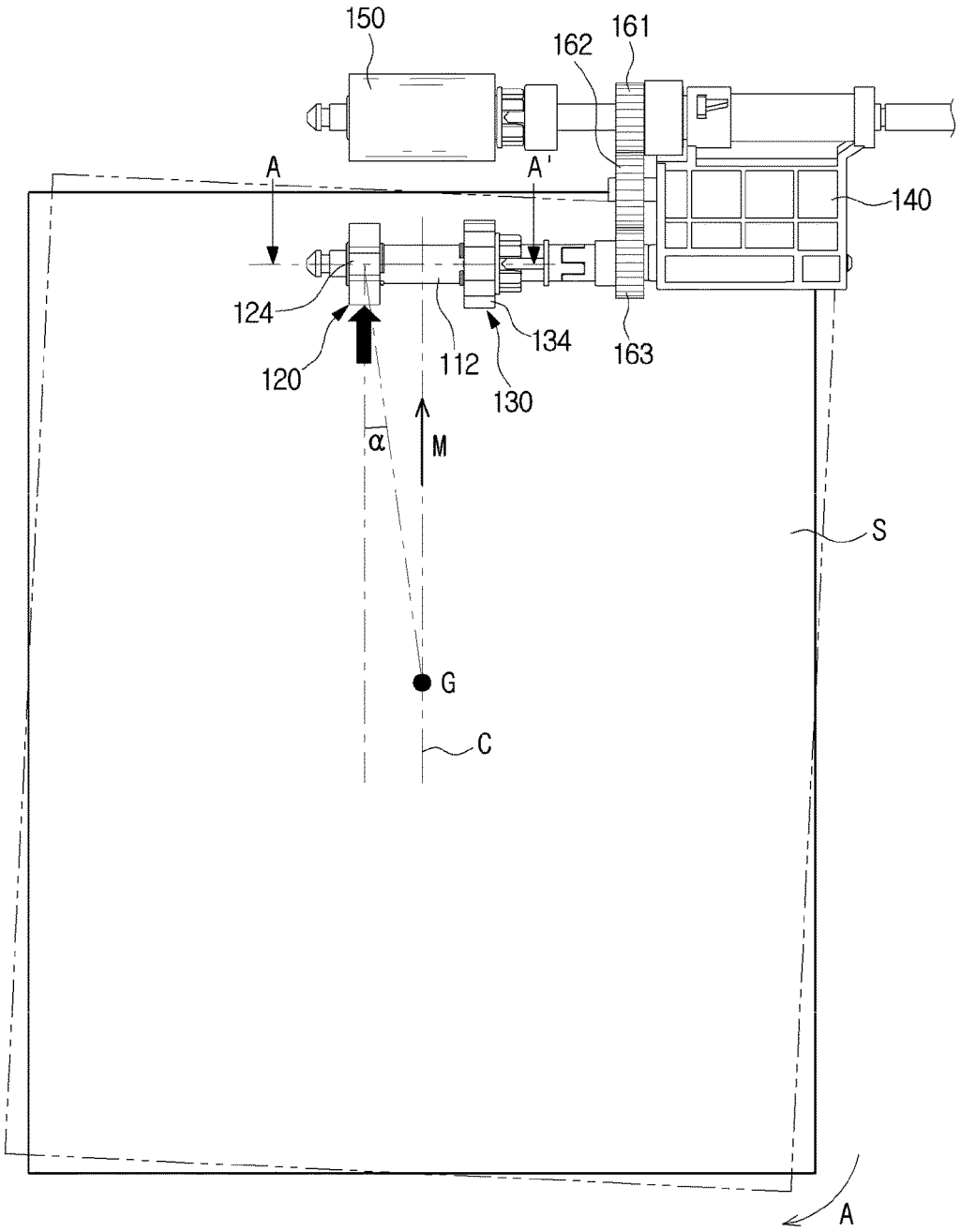
FIG. 6 is a view relating to a pickup operation of a print medium according to an embodiment of the disclosure.
Figure 7:
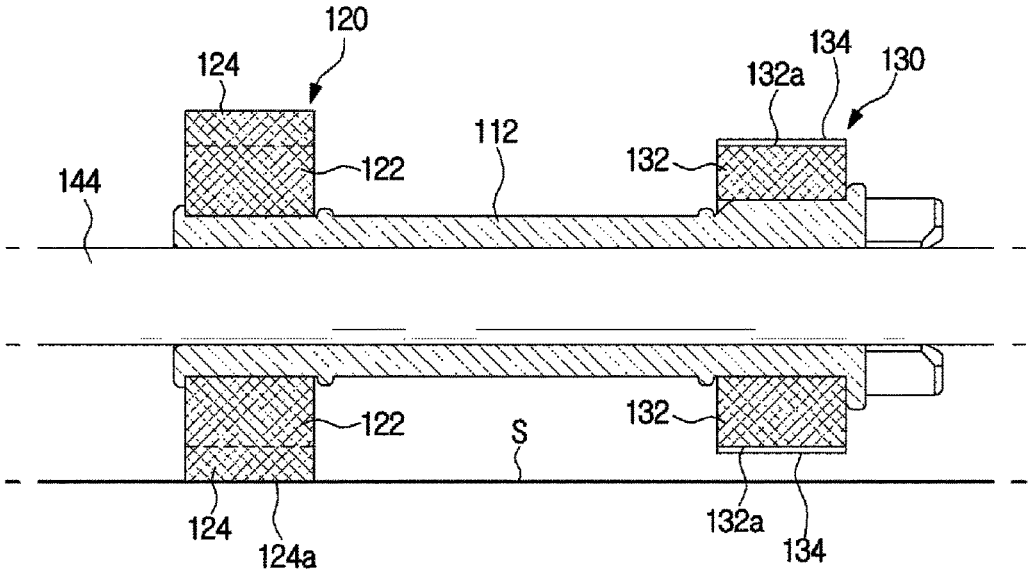
FIG. 7 is a cross-sectional view taken along line A-A' of FIG. 6.

FIG. 6 is a view relating to a pickup operation of a print medium according to one embodiment of the disclosure, and FIG. 7 is a cross-sectional view taken along line A-A' of FIG. 6.

When the first pickup block 124 comes into contact with and picks up a print medium S, since a center line C which passes through the center of gravity G of the print medium is spaced apart from a position at which the print medium S is picked up by the first pickup block 124, the print medium moves while slipping in direction A.

Adjusting a slip degree of a print medium may be variously performed depending on a plurality of factors. As one factor among the plurality of factors, as an angle $\alpha$ between a virtual line which connects the center of gravity G of a print medium and a position at which the first pickup block 124 comes into contact with the print medium and a virtual line drawn from a position at which the first pickup block 124 comes into contact with the print medium in a direction opposite to a supply direction M of the print medium becomes larger, a slip degree of the print medium in direction A becomes larger.

Figure 8:
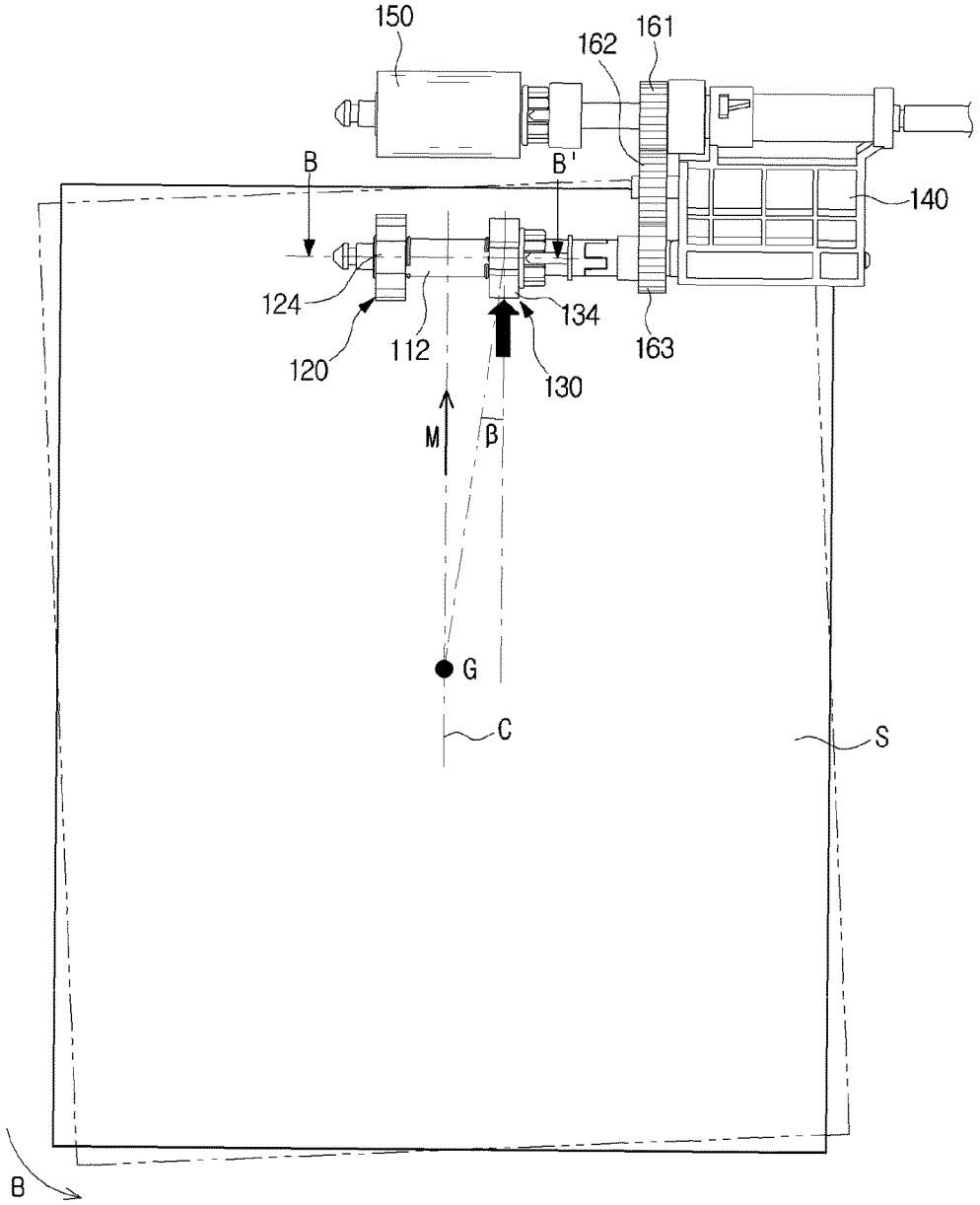
FIG. 8 is a view relating to an operation of picking up the print medium according to an embodiment of the disclosure.
Figure 9:
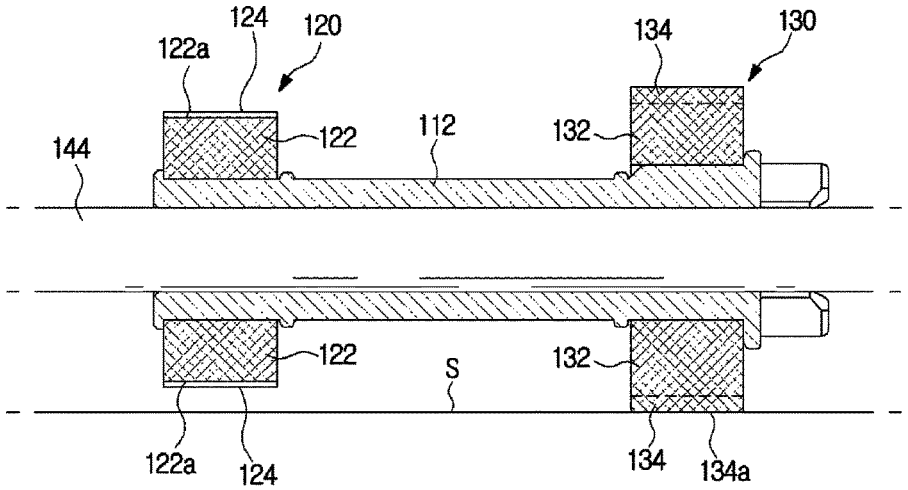
FIG. 9 is a cross-sectional view taken along line B-B' of FIG. 8.

FIG. 8 is a view relating to an operation of picking up the print medium according to one embodiment of the disclosure, and FIG. 9 is a cross-sectional view taken along line B-B' of FIG. 8.

When the second pickup block 134 comes into contact with and picks up a print medium, since the center line C which passes through the center of gravity G of the print medium is spaced apart from a position at which the print medium is picked up by the second pickup block 134, the print medium moves while slipping in direction B.

As an angle $\beta$ between a virtual line which connects the center of gravity of a print medium and a position at which the second pickup block 134 comes into contact with the print medium and a virtual line drawn from a position at which the second pickup block 134 comes into contact with the print medium in a direction opposite to a supply direction of the print medium becomes larger, a slip degree of the print medium in direction B becomes larger.

Since the pickup roller 110 moves the print medium S in a supply direction while slipping the print medium in direction A or B as described above, an uppermost print medium among the loaded print media can be easily picked up.

Figure 10:
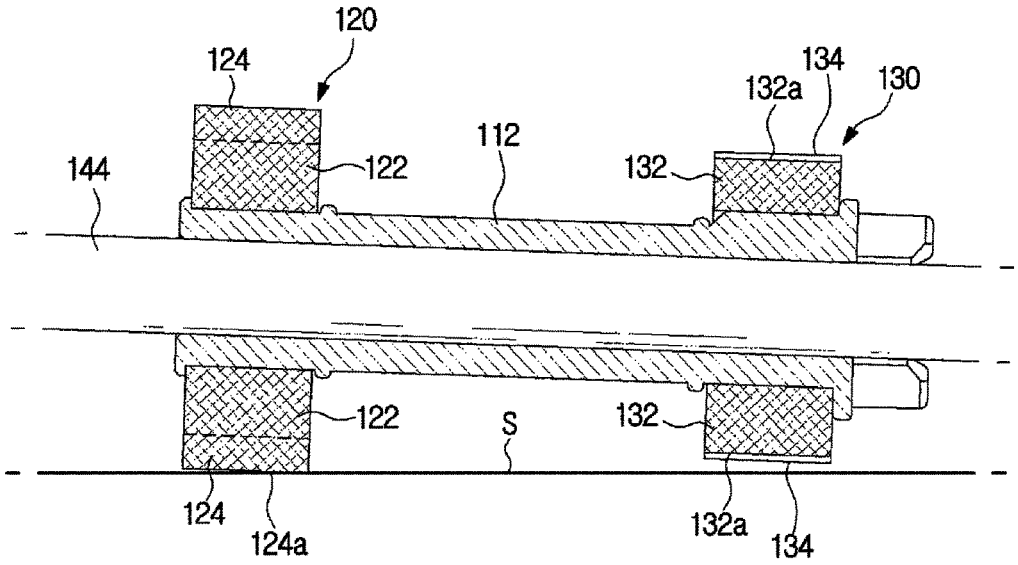
FIGS. 10 and 11 are views illustrating an operation of the pickup roller according to an embodiment of the disclosure while the pickup roller is inclined.
Figure 11:
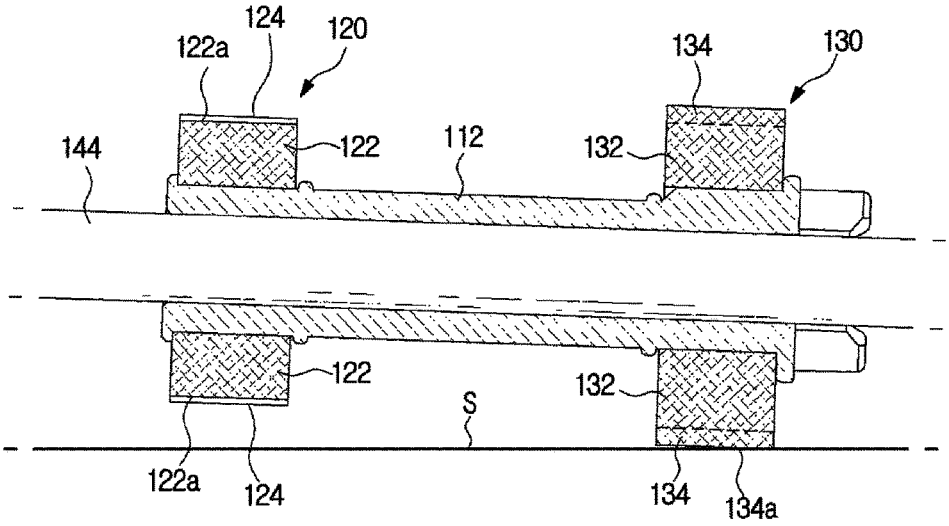

FIGS. 10 and 11 are views illustrating an operation of the pickup roller according to one embodiment of the disclosure while the pickup roller is inclined.

In the case of the pickup roller 110 according to the embodiment of the disclosure, even when the second shaft 144 which rotates the pickup roller 110 is disposed to be inclined at a predetermined angle, since the first and second pickup parts 120 and 130 may alternately come into contact with a loaded print medium, the lifetime of the pickup roller 110 may be increased.

This will be described with reference to FIGS. 10 and 11. When the second shaft 144 is inclined at a predetermined angle, the pickup roller 110 also rotates while being inclined at the predetermined angle. When the pickup roller 110 is formed in a cylindrical shape, since only a contact surface disposed close to a print medium S comes into contact with the print medium S, only the contact surface which comes into contact with the print medium S becomes worn due to repeating a pickup operation.

In the case of the pickup roller 110 according to the embodiment, since the first and second contact surfaces 124*a* and 134*a* are separated and alternately come into contact with the print medium S as illustrated in FIGS. 10 and 11, portions intensively worn may be dispersed even when repeating a pickup operation. Through this, the lifetime of the pickup roller 110 can be increased.

Hereinafter, the print medium supply apparatus and image forming apparatus having the same according to another embodiment of the disclosure will be described.

In the description of the embodiment, the structure described in the above embodiment will be omitted.

Figure 12:
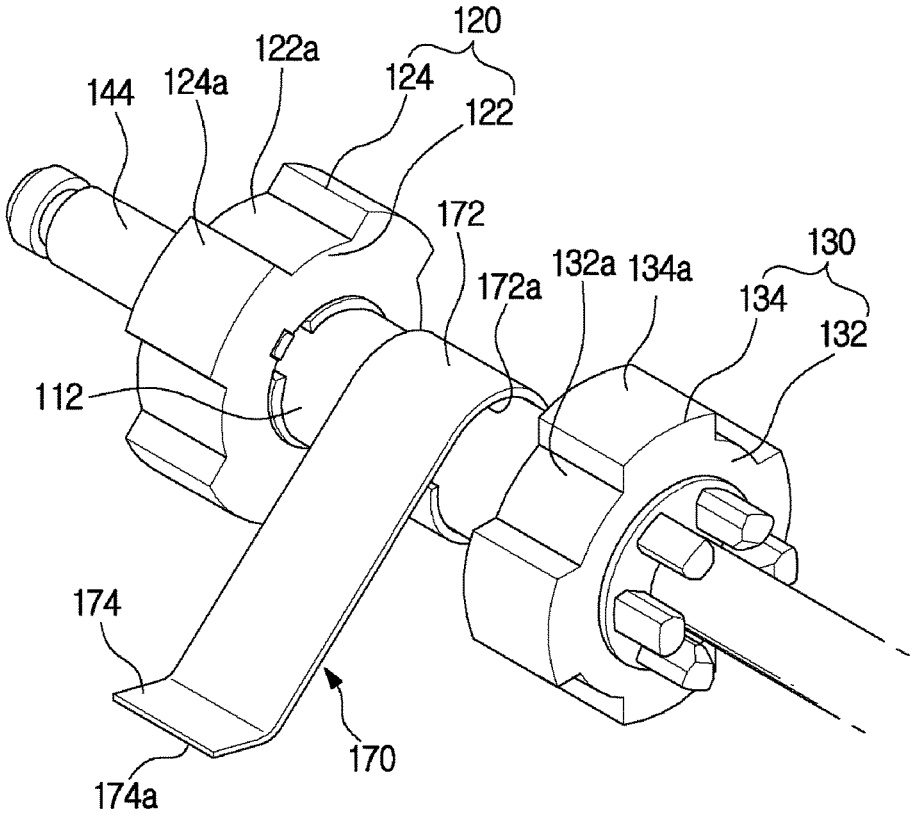
FIG. 12 is a perspective view illustrating a pickup roller and a press arm according to an embodiment of the disclosure.
Figure 13:
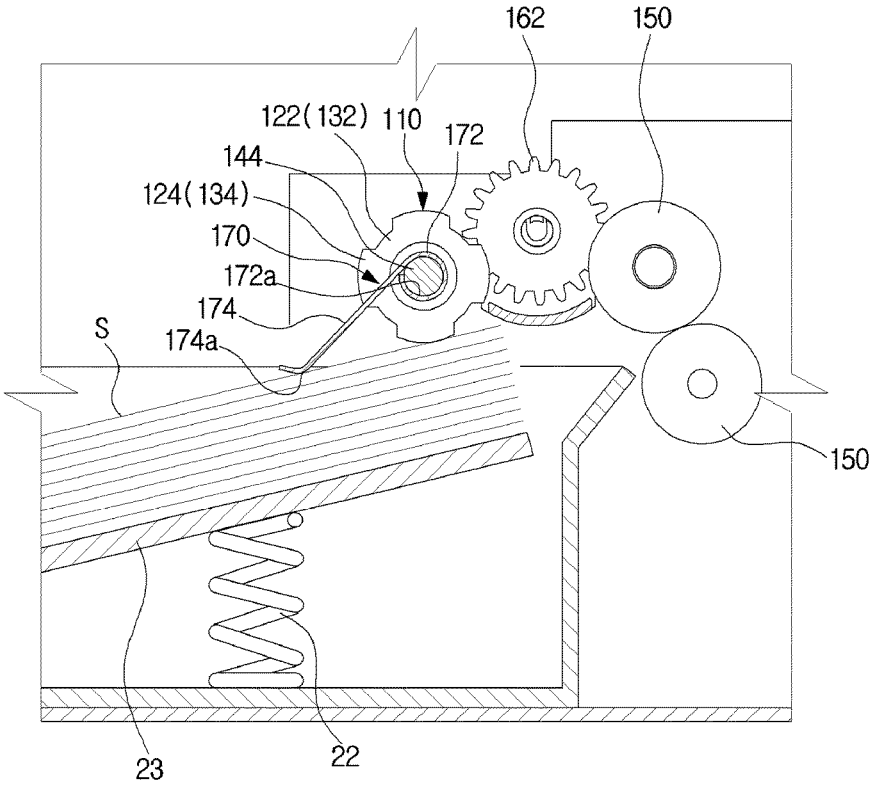
FIG. 13 is a cross-sectional view illustrating the pickup roller and the press arm according to an embodiment of the disclosure.

FIG. 12 is a perspective view illustrating a pickup roller and a press arm according to an embodiment of the disclosure, and FIG. 13 is a cross-sectional view illustrating the pickup roller and the press arm according to an embodiment of the disclosure.

A print medium supply apparatus 20 may further include a pressing bar 170.

The pressing bar 170 may be provided to come into contact with an upper portion of a loaded print medium S. Specifically, the pressing bar 170 is positioned at the upper portion of the loaded print medium S, and may be provided to come into contact with a position closer to a center of the print medium than a pickup roller 110.

The pressing bar 170 may be provided to come into contact with one position on the upper portion of the loaded print medium S such that the center of gravity G of the print medium moves toward the pickup roller 110.

The loaded print medium S may be biasedly picked up with respect to a supply direction M of the print medium by first and second pickup parts 120 and 130, and the pressing bar 170 may increase the biased degree thereof.

The pressing bar 170 may include a bar body 172 and a bar contact portion 174.

The bar body 172 operates independently of rotation of the pickup roller 110, and may be disposed to cover a perimeter of the roller body 112. Although the bar body 172 is positioned around the roller body 112, the bar body 172 is provided not to rotate with the roller body 112 but to operate independently of the pickup roller 110, by a slip occurring between an inner surface 172*a* of the bar body 172 and an outer surface of the roller body 112. That is, the bar body 172 is rotatably disposed about the roller body 112. Through such a structure, the pressing bar 170 may come into contact with an upper portion of the print medium S regardless of rotation of the roller body 112.

The bar contact portion 174 may be formed to extend from the bar body 172, and a bar contact surface 174*a* which comes into contact with a top surface of a loaded print medium S is formed at one end of the bar contact portion 174. The bar contact surface 174*a* is provided to come into contact with a position between the center of gravity G of the print medium and the pickup roller 110.

The bar contact portion 174 is provided to press an upper portion of a loaded print medium S with a predetermined force. However, the predetermined force is sufficient as long as movement of the print medium S is not interfered therewith and the center of gravity G of the print medium moves. The bar contact portion 174 may be provided to press the upper portion of the loaded print medium S with the weight thereof. However, the bar contact portion 174 is not limited thereto but may be provided with an additional elastic member connected to the bar contact portion 174 to press the print medium S.

The bar contact portion 174 may be positioned in a state of being disposed on an upper portion of a loaded print medium S.

Since the bar contact portion 174 comes into contact with the upper portion of the loaded print medium S, the center of gravity formed by the print medium and the bar contact portion 174 moves toward the pickup roller 110.

Hereinafter, an operation of the pickup roller 110 according to the embodiment will be described.

Figure 14:
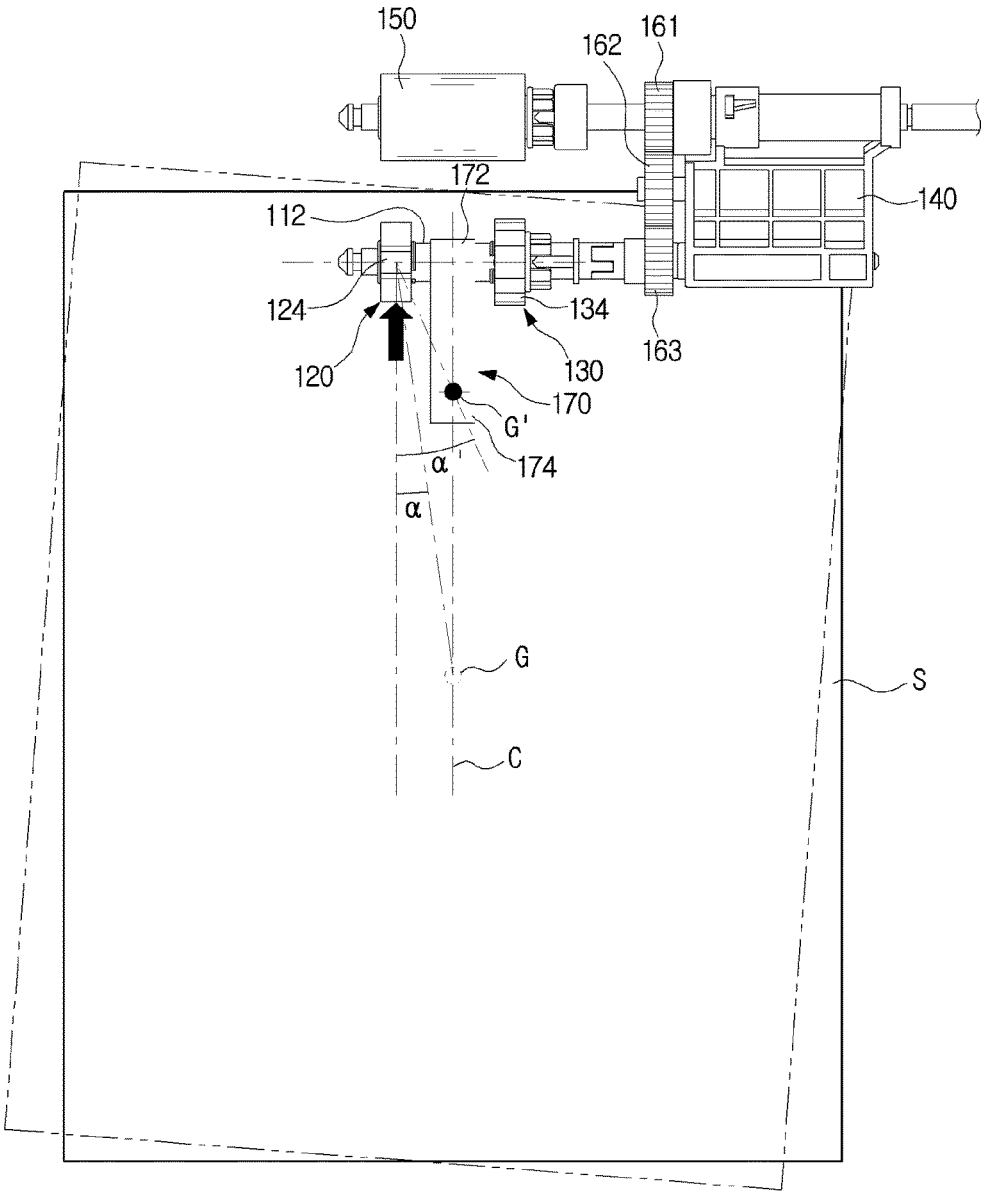
FIGS. 14 and 15 are views illustrating an operation of picking up a print medium according to an embodiment of the disclosure.
Figure 15:
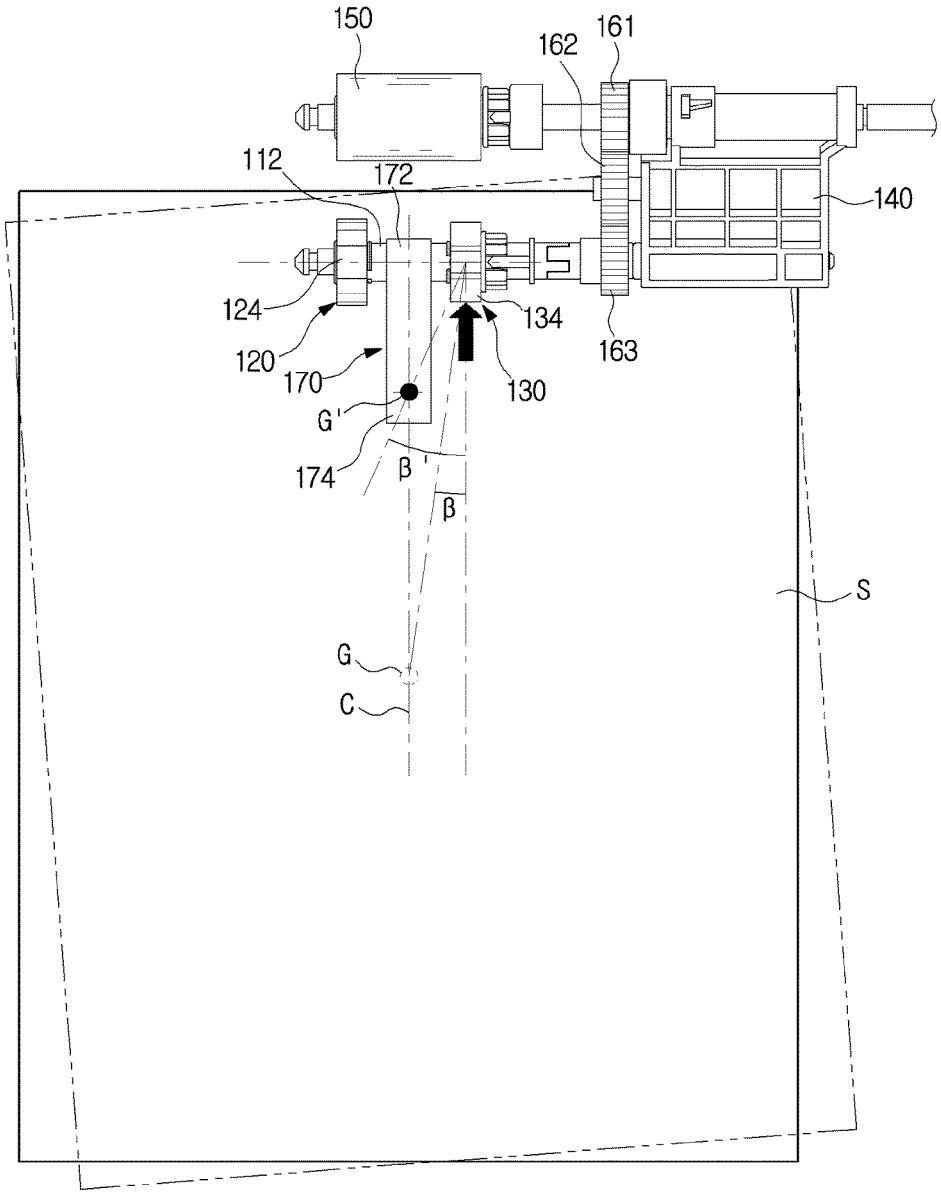

FIGS. 14 and 15 are views illustrating an operation of picking up a print medium according to an embodiment of the disclosure.

When the image forming apparatus operates, the loaded print medium is supplied one sheet at a time from an uppermost print medium by the pickup roller 110 in a supply direction of the print medium. The center of gravity formed by the print medium and a pressing arm is moved toward the pickup roller 110 by the pressing arm with respect to the center of gravity when there is no pressing arm.

When a print medium comes into contact with the first pickup block 124 and is picked up, since a center line which passes through the center of gravity of the print medium and a position at which the print medium is picked up by the first pickup block 124 are spaced apart from each other, the print medium moves while slipping in direction A. Since an angle α' between a virtual line which connects the center of gravity G' of the print medium changed by the bar contact portion 174 and a position at which the first pickup block 124 comes into contact with the print medium and a virtual line drawn from a position at which the first pickup block 124 comes into contact with the print medium in a direction opposite to a supply direction M of the print medium is greater than the angle α (see FIG. 6), a slip degree of the print medium in direction A may become larger.

In addition, when a print medium comes into contact with the second pickup block and is picked up, since a center line which passes through the center of gravity of the print medium and a position at which the print medium is picked up by the second pickup block are spaced apart from each other, the print medium moves while slipping in direction B.

Since an angle β' between a virtual line which connects the center of gravity G' of the print medium changed by the bar contact portion 174 and a position at which the second pickup block 134 comes into contact with the print medium and a virtual line drawn from a position at which the second pickup block 134 comes into contact with the print medium in a direction opposite to a supply direction of the print medium is greater than the angle β (see FIG. 8), a slip degree of the print medium in direction B may become larger.

Hereinafter, a print medium supply apparatus and an image forming apparatus having the same according to still another embodiment of the disclosure will be described.

In the description of the embodiment, the structure described in the above embodiment will be omitted.

Figure 16:
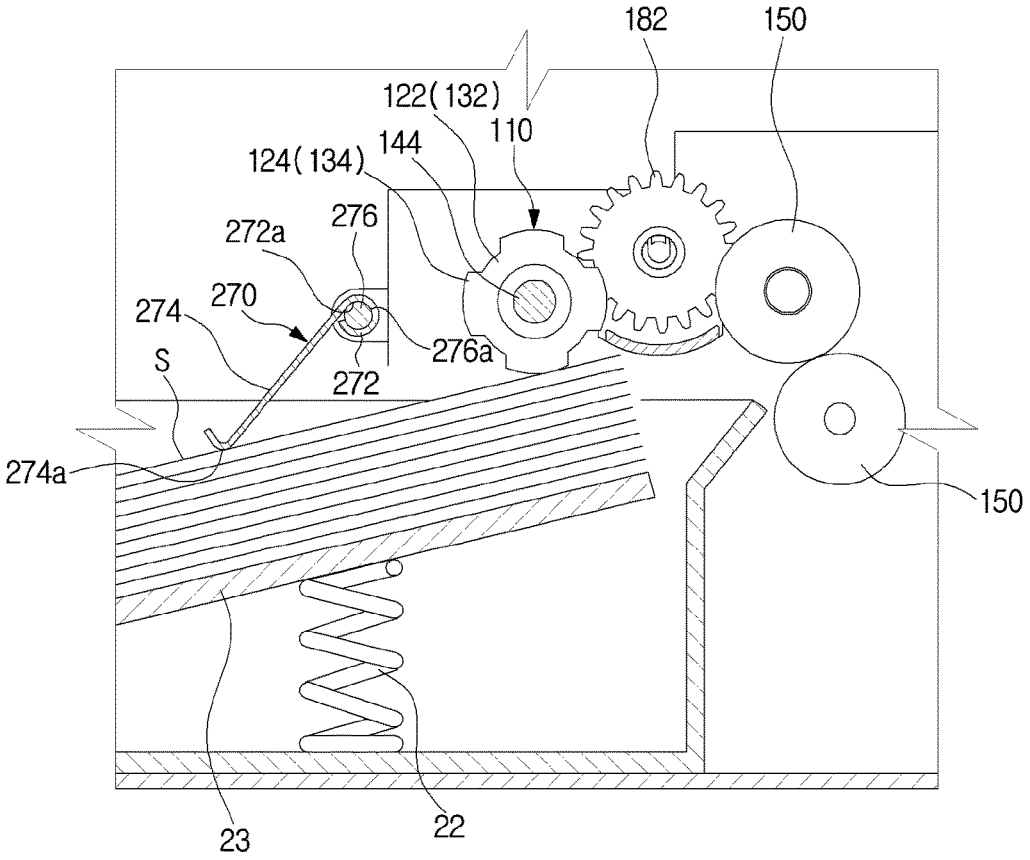
FIG. 16 is a cross-sectional view illustrating a print medium supply apparatus according to an embodiment of the disclosure.

FIG. 16 is a cross-sectional view illustrating a print medium supply apparatus according to an embodiment of the disclosure.

A pressing bar 270 may include a bar body 272 and a bar contact portion 274.

The bar body 272 may be rotatably provided in a main body. Since the bar body 272 is positioned in the main body rather than at a pickup roller 110, the bar body 272 may be managed separately from the pickup roller 110.

The bar body 272 is provided to operate independently of a pressing bar rotating shaft 276 provided in the main body. Specifically, a slip may occur between an inner surface 272*a* of the bar body 272 and an outer surface 276*a* of the pressing bar rotating shaft 276. Through such a structure, the pressing bar 270 may come into contact with an upper portion of a print medium regardless of an amount of the loaded print medium.

A bar contact portion 274 is formed to extend from the bar body 272, and a bar contact surface 274*a* which comes into contact with a top surface of the loaded print medium is formed at one end of the bar contact portion 274. The bar contact surface 274*a* is provided to come into contact with a position between the center of gravity G of the print medium and the pickup roller 110.

Hereinafter, a print medium supply apparatus and image forming apparatus having the same according to an embodiment of the disclosure will be described.

In the description of the embodiment, the structure described in the above embodiment will be omitted.

Figure 17:
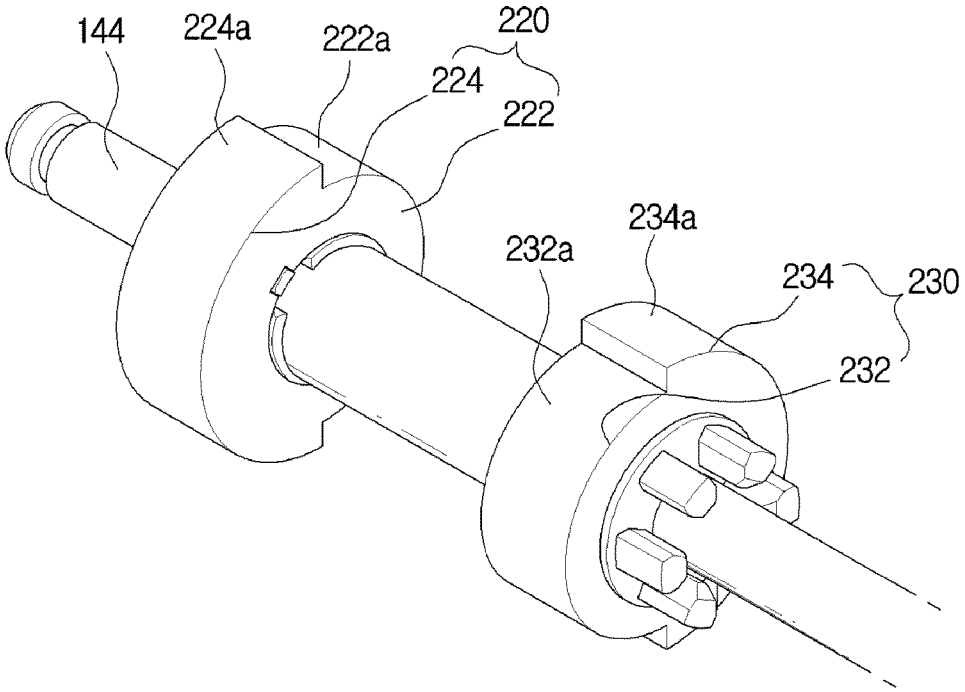
FIG. 17 is a perspective view illustrating a pickup roller according to an embodiment of the disclosure.

FIG. 17 is a perspective view illustrating a pickup roller according to an embodiment of the disclosure.

A pickup roller 210 may include first and second pickup parts 220 and 230.

The first and second pickup parts 220 and 230 are provided to come into contact with a print medium and also to rotate with rotation of the pickup roller 210. The first and second pickup parts 220 and 230 are provided to biasedly pick up the print medium from a print medium tray with respect to a supply direction of the print medium.

The first and second pickup parts 220 and 230 may be respectively and biasedly disposed toward one and the other sides with respect to a center of a width of the print medium. Specifically, a roller body 212 may be disposed on a center of a width of the print medium, and the first and second pickup parts 220 and 230 may be respectively disposed at one and the other sides of the roller body 212. That is, the first and second pickup parts 220 and 230 may be disposed at one and the other sides of the roller body 212 to face each other.

The first and second pickup parts 220 and 230 may respectively include first and second pickup bodies 222 and 232. The first and second pickup bodies 122 and 132 are provided to form bodies of the first and second pickup parts 220 and 230 and to cover a perimeter of the roller body 212.

The first and second pickup parts 220 and 230 may respectively include first and second pickup blocks 224 and 234. When pickup is performed, the first and second pickup blocks 224 and 234 each are provided to come into direct contact with a print medium to pick up one sheet from an uppermost print medium among the loaded print medium at a time.

The first and second pickup blocks 224 and 234 may be provided to be disposed along a perimeter of the pickup roller 210. Specifically, the first and second pickup blocks 224 and 234 are respectively provided to be disposed along perimeters of the first and second pickup body 222 and 232. The pickup blocks may be formed to protrude from the pickup bodies.

One first pickup block 224 and one second pickup block 234 are provided. The first and second pickup blocks 224 and 234 may be respectively provided along circumferences of the first and second pickup bodies 222 and 232 in a semicircular shape. First and second contact surfaces 224*a* and 234*a* may be formed at outermost perimeters of the first and second pickup blocks 224 and 234, and first and second non-contact surfaces 222*a* and 232*a* may be formed at outer perimeters of the first and second pickup bodies 222 and 232 at which the first and second pickup blocks 224 and 234 are not formed.

The first and second pickup blocks 224 and 234 may be mutually alternately disposed in a circumferential direction of the pickup roller 210.

Through such a structure, the first and second pickup blocks 224 and 234 may alternately come into contact with an upper portion of the loaded print medium by the pickup roller 210. That is, in an operation of picking up a print medium S, at least only one pickup block of the first pickup block 224 and the second pickup block 234 may come into contact with the print medium.

Hereinafter, a print medium supply apparatus and an image forming apparatus having the same according to an embodiment of the disclosure will be described.

In the description of the embodiment, the structure described in the above embodiment will be omitted.

Figure 18:
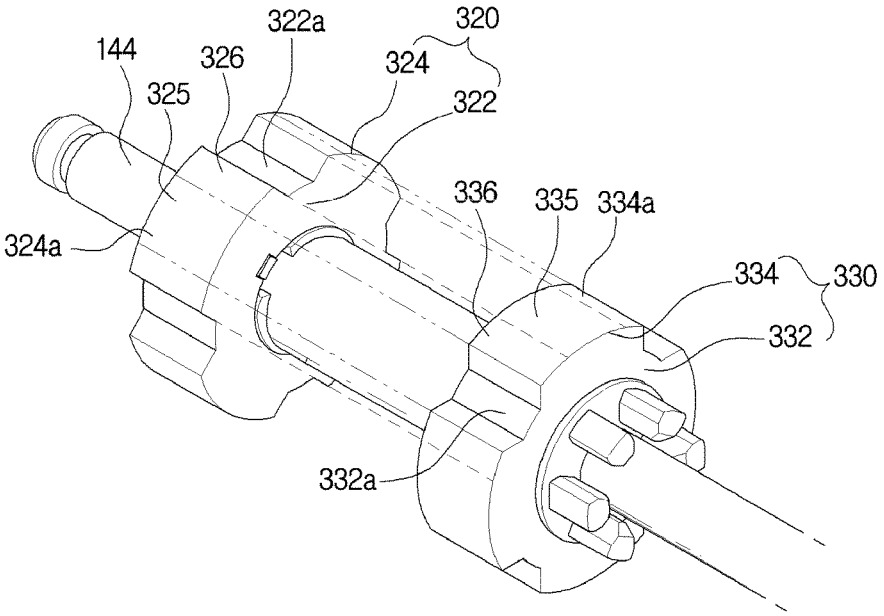
FIG. 18 is a perspective view illustrating a pickup roller according to an embodiment of the disclosure.

FIG. 18 is a perspective view illustrating a pickup roller according to an embodiment of the disclosure.

A pickup roller 310 may include first and second pickup parts 320 and 330.

The first and second pickup parts 320 and 330 may respectively include first and second pickup bodies 322 and 332 and first and second pickup blocks 324 and 334. First and second contact surfaces 324*a* and 334*a* may be formed at outermost perimeters of the first and second pickup blocks 324 and 334, and first and second non-contact surfaces 322*a* and 332*a* may be formed at outer perimeters of the first and second pickup bodies 322 and 332 at which the first and second pickup blocks 324 and 334 are not formed.

At least one first pickup block 324 may include a first independent pickup section 325 and a first common pickup section 326.

The first independent pickup section 325 is a section at which only the first pickup block 324 comes into contact with a loaded print medium. When the first independent pickup section 325 comes into contact with a print medium, the print medium moves while slipping in direction A as described above.

The first common pickup section 326 is a section at which the first pickup block 324 and the second pickup block 334 simultaneously come into contact with and pick up the loaded print medium. That is, the first common pickup section 326 and a second common pickup section 336 of the second pickup block 334 which will be described below come into contact with the print medium.

At least one second pickup block 334 may include a second independent pickup section 335 and the second common pickup section 336.

The second independent pickup section 335 is a section at which only the second pickup block 334 comes into contact with the loaded print medium. When the second independent pickup section 335 comes into contact with the print medium, the print medium moves while slipping in direction B as described above.

The second common pickup section 336 is a section at which the first pickup block 324 and the second pickup block 334 simultaneously come into contact with and pick up the loaded print medium. That is, the second common pickup section 336 and the first common pickup section 326 of the first pickup block 324 come into contact with a print medium.

As described above, the first and second pickup blocks 324 and 334 alternately come into contact with a print medium, and in the first and second common pickup sections, the first and second pickup blocks 324 and 334 may simultaneously come into contact with the print medium, and may smoothly supply the print medium.

Hereinafter, a print medium supply apparatus and an image forming apparatus having the same according to an embodiment of the disclosure will be described.

In the description of the embodiment, the structure described in the above embodiment will be omitted.

Figure 19:
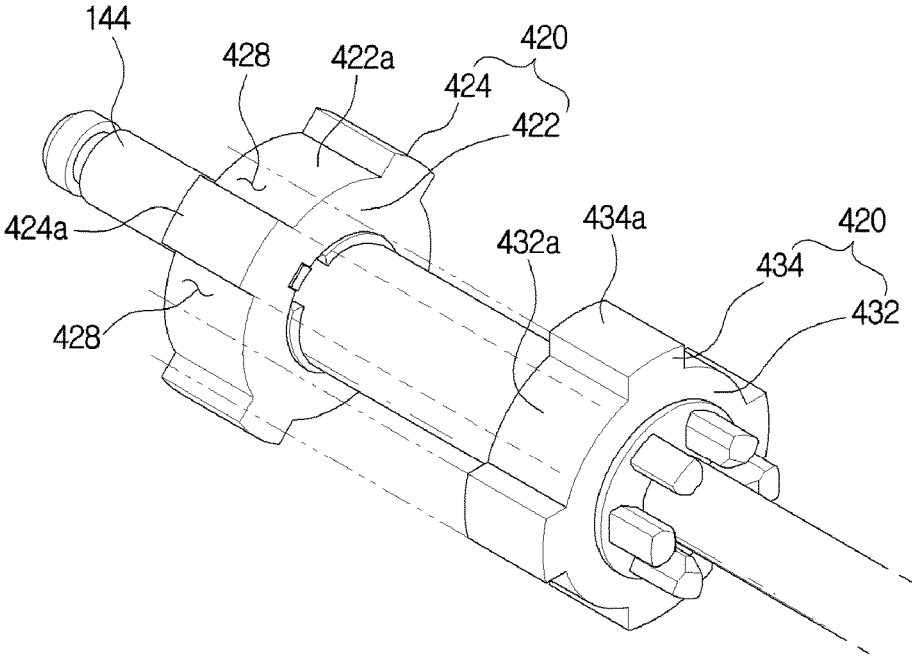
FIG. 19 is a perspective view illustrating a pickup roller according to an embodiment of the disclosure.

FIG. 19 a perspective view illustrating a pickup roller according to an embodiment of the disclosure.

A pickup roller 410 may include first and second pickup parts 420 and 430

The first and second pickup parts 420 and 430 may respectively include first and second pickup bodies 422 and 432 and first and second pickup blocks 424 and 434. First and second contact surfaces 424*a* and 434*a* may be formed at outermost perimeters of the first and second pickup blocks 424 and 434, and first and second non-contact surfaces 422*a* and 432*a* may be formed at outer perimeters of the first and second pickup bodies 422 and 432 at which the first and second pickup blocks 424 and 434 are not formed.

A plurality of first pickup blocks 424 formed on the first pickup body 422 and a plurality of second pickup blocks 434 formed on the second pickup body 432 are mutually alternately disposed and may be disposed to be spaced apart from each other in a circumferential direction.

That is, the pickup roller 410 may further include a space section 428 at which neither the first pickup block 424 nor the second pickup block 434 comes into contact with a print medium during a pickup operation and which is formed in a circumferential direction of the pickup roller 410.

As is apparent from the above description, a print medium supply apparatus and an image forming apparatus having the same can solve a problem in which a pickup operation is not uniformly performed according to types or states of the loaded print medium by improving pickup performance.

While one or more example embodiments of the disclosure have been illustrated and described above in detail with reference to the figures, it will be understood by those of ordinary skill in the art that the embodiments may be variously modified by those skilled in the art without departing from the principles and spirit of the technological scope of the disclosure, the scope of which is defined by the appended claims and their equivalents.

What is claimed is:

1. An image forming apparatus, comprising:
a print medium tray to be loaded with a print medium;
a pickup roller to pick up the print medium from the print medium tray, the pickup roller including:
at least one first pickup block,
at least one second pickup block to alternately come into contact with an upper portion of the print medium, and
a roller body which forms a body of the pickup roller and at which the at least one first pickup block is disposed at one end thereof and the at least one second pickup block is disposed at the other end thereof; and
a pressing bar, disposed between the one end and the other end of the roller body and rotatably disposed around the roller body, to come into contact with the upper portion of the print medium at an upstream position with respect to a position of the pickup roller in a supply direction of the print medium.

2. The image forming apparatus of claim 1, wherein the first and second pickup blocks are respectively and biasedly disposed at one and the other sides with respect to a center of a width of the print medium to biasedly pick up the print medium with respect to a supply direction of the print medium.

3. The image forming apparatus of claim 2, wherein
the at least one first pickup block and the at least one second pickup block are respectively disposed at one and the other sides of the pickup roller along a perimeter of the pickup roller, and
the at least one first pickup block and the at least one second pickup block are mutually alternately disposed in a circumferential direction of the pickup roller.

4. The image forming apparatus of claim 1, wherein the at least one first pickup block and the at least one second pickup block are to alternately come into contact with the upper portion of the print medium by rotation of the pickup roller.

5. The image forming apparatus of claim 1, wherein:
the at least one first pickup block and the at least one second pickup block respectively include a plurality of first pickup blocks and a plurality of second pickup blocks, which are spaced apart from each other in a circumferential direction of the pickup roller.

6. The image forming apparatus of claim 5, wherein the plurality of first pickup blocks and the plurality of second pickup blocks are mutually alternately disposed in the circumferential direction of the pickup roller.

7. The image forming apparatus of claim 1, wherein the pressing bar is spaced apart from the at least one first pickup block and the at least one second pickup block in an axial direction of the roller body.

8. The image forming apparatus of claim 1, wherein the pressing bar includes:
a bar body to operate independently of rotation of the pickup roller and rotatably disposed around the roller body; and
a bar contact portion to extend from the bar body and to come into contact with the upper portion of the print medium.

9. The image forming apparatus of claim 8, wherein the bar contact portion is to come into contact with the upper portion of the print medium at the upstream position with respect to the position of the pickup roller in the supply direction of the print medium.

10. The image forming apparatus of claim 1, wherein:
the at least one first pickup block includes:
a first independent contact section to come into contact with the print medium, and
a first common contact section adjacent to the first independent contact section and to come into contact with the print medium at a same time as the at least one second pickup block, and
the at least one second pickup block includes:
a second independent contact section to come into contact with the print medium, and
a second common contact section adjacent to the second independent contact section and to come into contact with the print medium at a same time as the at least one first pickup block.

11. The image forming apparatus of claim 1, wherein the pickup roller includes a space section in which, when a pickup operation is performed by the pickup roller, neither the at least one first pickup block nor the at least one second pickup block comes into contact with the print medium and which is formed in a circumferential direction of the pickup roller.

12. An image forming apparatus, comprising:
a main body; and
a print medium supply apparatus including a pickup roller to pick up a print medium and to supply the print medium to the main body, the pickup roller including:
a roller body rotatably provided,
a first pickup part including at least one first pickup block which protrudes in a radial direction of the pickup roller and disposed at one side of the roller body, and
a second pickup part including at least one second pickup block, which protrudes in the radial direction of the pickup roller and disposed at another side of the roller body, and
the at least one first pickup block and the at least one second pickup block are mutually alternately disposed in a circumferential direction of the pickup roller,
wherein
the at least one first pickup block includes:
a first independent contact section to come into contact with the print medium, and
a first common contact section, adjacent to the first independent contact section in the circumferential direction, to come into contact with the print medium at a same time as the at least one second pickup block, and
the at least one second pickup block includes:
a second independent contact section to come into contact with the print medium, and
a second common contact section, adjacent to the second independent contact section in the circumferential direction, to come into contact with the print medium at a same time as the at least one first pickup block.

13. The image forming apparatus of claim 12, wherein the pickup roller is disposed on a center line of a width of the print medium.

14. The image forming apparatus of claim 12, wherein the at least one first pickup block and the at least one second pickup block are to alternately come into contact with an upper portion of the print medium by rotation of the pickup roller.

15. The image forming apparatus of claim 12, wherein the at least one first pickup block and the at least one second pickup block respectively include a plurality of first pickup blocks and a plurality of second pickup blocks, which are spaced apart from each other in the circumferential direction of the pickup roller.

16. The image forming apparatus of claim 12, further comprising a pressing bar to come into contact with an upper portion of the print medium at an upstream position with respect to a position of the pickup roller in a supply direction of the print medium.

17. The image forming apparatus of claim 16, wherein the pressing bar includes:

a bar body to operate independently of rotation of the pickup roller and rotatably disposed around the roller body; and a bar contact portion formed to extend from the bar body and to come into contact with the upper portion of the print medium.

18. The image forming apparatus of claim 17, wherein the bar contact portion is to come into contact with the upper portion of the print medium at the upstream position with respect to the position of the pickup roller in the supply direction of the print medium.

19. A method of supplying a print medium in an image forming apparatus including a print medium tray in which a print medium is loaded, the method comprising:

picking up the print medium from the print medium tray, by a pickup roller having first and second pickup blocks, the picking up including:

contacting, by a first independent contact section of the first pickup block, the print medium to cause the print medium to slip in a first direction, contacting, by a first common contact section of the first pickup block disposed adjacent to the first independent contact section in a circumferential direction of the pickup roller, the print medium at a same time as a second common contact section of the second pickup block contacts the print medium, and contacting, by a second independent contact section of the second pickup block disposed adjacent to the second common contact section in the circumferential direction, the print medium to cause the print medium to slip in a second direction opposite the first direction.

20. The method of claim 19, wherein the first and second pickup blocks are respectively and biasedly disposed at one and the other sides with respect to a center of a width of the print medium to biasedly pick up the print medium with respect to a supply direction of the print medium.

* * * * *